US005471680A

United States Patent [19]

Vesterinen

[11] Patent Number: 5,471,680

[45] Date of Patent: Dec. 5, 1995

[54] PROTECTIVE BELTS WITH GARMENT ATTACHMENT MEANS ADJUSTABLE IN A PLURALITY OF VERTICAL POSITIONS

[76] Inventor: Yrjo H. Vesterinen, Barry Cottage, Golf Club Road, Hook Heath, Woking GU22 OLU, United Kingdom

[21] Appl. No.: 179,772

[22] Filed: Jan. 10, 1994

Related U.S. Application Data

[63] Continuation of Ser. No. 950,475, Sep. 24, 1992, abandoned.

[30] Foreign Application Priority Data

Sep. 25, 1991 [GB] United Kingdom ..... 9120452

[51] Int. Cl.[6] ..... A61F 5/02

[52] U.S. Cl. ..... 2/44; 2/2; 2/338; 602/19

[58] Field of Search ..... 2/2, 44, 300, 311, 2/336, 338, 302, 312, 325, 76, 237, 221; 128/100.1, 101.1, 121.1, 96.1; 602/19

[56] References Cited

U.S. PATENT DOCUMENTS 954,849 4/1910 Blake ..... 2/44
4,397,046 8/1983 Steiner ..... 2/44
4,833,730 5/1989 Nelson ..... 2/44
5,046,488 9/1991 Schiek, Sr. ..... 2/44

OTHER PUBLICATIONS

Gershman, M.D., Maurice; "Self-Adhering Nylon Tapes"; Journal of the American Medical Assn., vol. 68, No. 7, p. 930.

*Primary Examiner*—Clifford D. Crowder
*Assistant Examiner*—Gloria Hale
*Attorney, Agent, or Firm*—Florence U. Reynolds

[57] ABSTRACT

The belt for protecting the lower spinal region of a wearer from injury by impact or abrasion when engaging in a hazardous activity, such as motocross, is provided with sets of male press studs and/or touch and close fasteners. Cooperating sets of female studs and/or touch and close fasteners are provided on the inner waistband of trousers to enable the belt and the trousers to be secured together in a variety of different relative vertical positions to suit the body shape of the wearer.

9 Claims, 1 Drawing Sheet

PROTECTIVE BELTS WITH GARMENT ATTACHMENT MEANS ADJUSTABLE IN A PLURALITY OF VERTICAL POSITIONS

This application is a continuation of application Ser. No. 07/950,475, filed Sep. 24, 1992, now abandoned.

BACKGROUND OF THE INVENTION

This invention relates to protective belts of the type used to protect from injury by impact or abrasion the lower spinal region of a wearer engaged in a hazardous activity, for example motocross.

Traditionally such a belt has been made separately from the trousers with the consequence that the belt tends to ride up from its optimum position. This displacement has the following disadvantages:

1) The protection afforded is reduced, and at worst the wearer's most vulnerable area may be left unprotected;

2) A gap is created between the belt and the top of the trousers through which dirt can enter, with resulting irritant effects on the wearer;

3) If a shirt is worn outside the belt and simply tucked into the trousers, the bottom of the shirt tends to ride up.

A partial alleviation of the above disadvantages has been obtained by forming the belt and trousers as a single garment. However such a unitary garment has the disadvantage that, although the belt remains in the same position relative to the trousers, it may nevertheless not be in the best possible protective position; that the purchaser of a combined garment has to lay out a larger sum of money at one time; that no other combinations of belt and trousers are possible thus precluding different color and design effects; and that it is necessary to replace the whole garment even if only the belt or trousers needs replacement.

SUMMARY OF THE INVENTION

According to the present invention these disadvantages are overcome by providing attachment means which enable the belt and trousers to be attached to one another in at least one relative vertical position. Any sort of releasable fastener known for use on clothing may be employed but preferred types are press studs and hook and loop fasteners, which latter have the advantage of allowing infinitely variable relative positioning.

Desirably the co-operating parts of the fastener are permanently secured to the respective garments; and only the adjacent rear portions of the garments arranged to be attachable. Preferably the waistband of the trousers should overlap the lower portion of the belt, although it could be inside.

BRIEF DESCRIPTION OF THE DRAWINGS

Although the invention may be carried out in a great variety of ways, one particular embodiment thereof will now be described, by way of example, with reference to the accompanying drawings in which.

DETAILED DESCRIPTION

Figure 1:
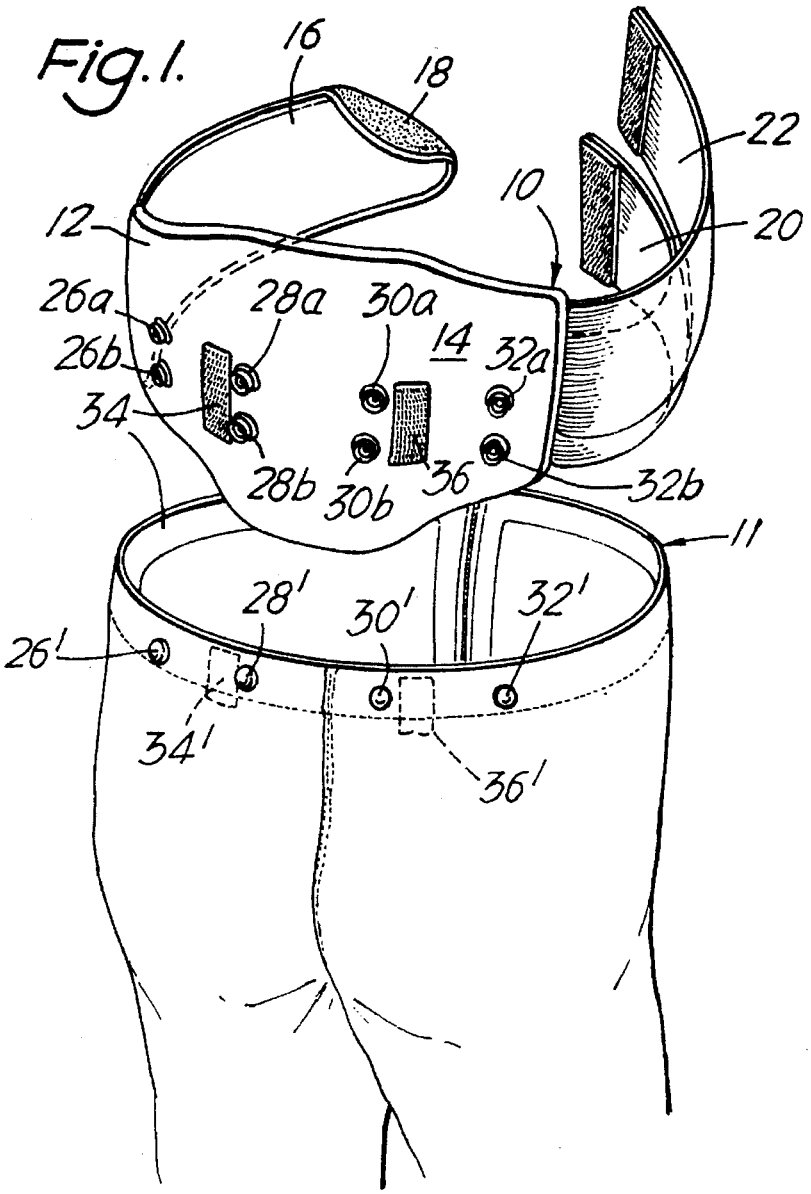
FIG. 1 is an exploded rear perspective view of a kidney belt/trousers combination according to the invention; and, FIG. 2 is a similar view of the combination fitted together in selected relative positions.
Figure 2:
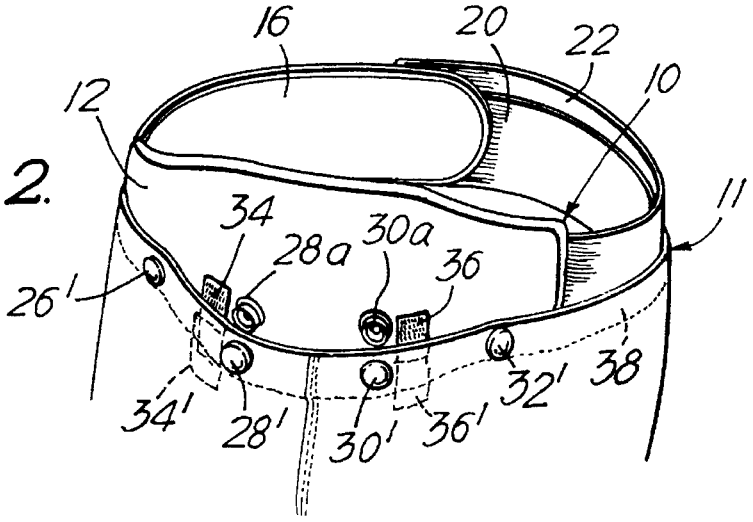

In FIGS. 1 and 2 there is shown a kidney belt 10 and a pair of trousers 11, both generally of known type and suitable to be worn for motocross. The belt 10 comprises a kinetic energy absorbent panel 12 typically comprising a padding layer of plastics foam covered on the outside with a "Lycra"-type material 14. The panel 12 may have any suitable configuration of foam padding and ventilation areas, and desirably has the edges and seams formed by high frequency welding, rather than by stitching which is not only more labor intensive, but also does not give a nicely contoured edge. The belt 10 is secured around the wearer's abdomen by a single tongue 16 extending from the left hand side of the panel 12 and faced on its outside with a layer 18 of the smooth component of a hook and loop fastener of the type sold under the name "Velcro"; and, extending from the right hand side of the panel 12, a shorter tongue 20 and an overlying longer tongue 22, each tongue having at its outer end a panel 24 of the other component of the hook and loop fastener.

Secured to the panel 12 are four pairs of male studs 26*a*,26*b*; 28*a*,28*b*; 30*a*,30*b*; and 32*a*,32*b*; and two strips 34,36 of the rougher component of a hook and loop fastener.

The trousers 11 are constructed of a suitable fabric and provided with a strong internal waist-band 38 to which are fitted four female studs 26', 28', 30' and 32', and two co-operating, smoother strips of the hook and loop fastener 34', 36'.

After the wearer has put on the kidney belt 10 in the correct position for maximum protection he will put on the trousers 11 engaging the female studs 26'–32' with the most appropriate one of the respective pairs of male studs 26*a*, *b*–32*a*,*b* to give the best relative position of the belt 10 and trousers 11 in accordance with his particular body shape. In the particular case shown in FIG. 2 the outer female studs 26',32' are engaged with the upper outer male studs 26*a*,32*a*, and the inner female studs 28',30' with the lower inner male studs 28*b*,30*b*. With another wearer it might be necessary, to achieve the optimum fitting, to engage for example the outer female studs with the lower corresponding male studs, and the inner female studs with upper male studs. The strips 34,34' and 36,36' engage automatically in the correct positions and serve to strengthen the attachment of the belt 10 to the trousers 11. Once the wearer has found the correct relative position of the belt and trousers they can of course be fastened together before being put on.

In other versions of the combination studs alone may be used for effecting attachment; and more than two rows of studs may be provided. On the other hand attachment may be effected entirely by hook and loop fasteners in which case a strip of one component of the fastener may be secured around a back portion of the waistband; and, say, four vertical strips of the other component may be secured to the belt. Such strips should have a sufficient vertical dimension to allow for the fullest possible range of adjustment, which of course will be infinitely variable within the range, and a sufficient lateral dimension to ensure secure attachment. Other combinations such as a central panel and two outer panels, are of course possible. Again, in another method of providing fine adjustment there may be employed fasteners of the type in which a runner may be locked in a track in a series of different positions.

I claim:

1. A protective belt for protecting the lower spinal region of a wearer from injury by impact or abrasion when engaged in a hazardous activity, said belt comprising a rear, kinetic energy absorbent panel of plastics foam and permanently secured attachment means on the lower portion of said panel to enable attachment of said belt to the upper edge of trousers in a choice of a plurality of relative vertical positions on said panel in order to conform to the body shape of the wearer to maintain the panel in protective position over the lower spinal area of the wearer.

2. The protective belt as claimed in claim 1, wherein said belt is a kidney belt.

3. A protective garment assembly for protecting the lower spinal region of a wearer from injury by impact or abrasion when engaged in a hazardous activity, said assembly comprising a belt having a rear, kinetic energy absorbent panel of plastics foam; trousers having a waistband; and attachment means for attaching the lower portion of the rear panel of the belt to the waistband at the rear portion of the trousers in a choice of a plurality of relative vertical positions on the belt conforming to the body shape of a wearer to maintain the panel in protective position over the lower spinal area of the wearer, wherein said means comprise at least one set of cooperating fasteners, one member of each set being permanently secured to the lower portion of the rear panel of the belt and the other cooperating member of each set being permanently secured to the waistband at the rear portion of the trousers.

4. The protective garment assembly as claimed in claim 3, wherein said belt is a kidney belt.

5. The protective garment assembly as claimed in claim 3, wherein the attachment means are arranged such that the trousers overlap the lower portion of the belt.

6. The protective garment assembly as claimed in claim 3, wherein the attachment means enable the belt and trousers to be attached to one another in a chosen one of a number of predetermined relative positions on the belt.

7. The protective garment assembly as claimed in claim 6, wherein the attachment means are press studs.

8. The protective garment assembly as claimed in claim 3, wherein the attachment means enable the belt and trousers to be attached to one another in a chosen relative position which is infinitely variable within a predetermined range.

9. The protective garment assembly as claimed in claim 8, wherein the attachment means are hook and loop fasteners.

* * * * *